United States Patent [19]

Magnon et al.

[11] Patent Number: 5,070,361

[45] Date of Patent: Dec. 3, 1991

[54] MOLDED CASE CIRCUIT BREAKER OPERATING MECHANISM ASSEMBLY

[75] Inventors: Gary D. Magnon, Bristol; Raymond K. Seymour; David J. Lesslie, both of Plainville; Michael C. Guerrette, Plymouth; Geoffrey H. McKay, West Hartford, all of Conn.

[73] Assignee: General Electric Company, N.Y.

[21] Appl. No.: 620,174

[22] Filed: Nov. 30, 1990

[51] Int. Cl.[5] ..... H01H 9/00

[52] U.S. Cl. ..... 335/172; 335/21; 335/190

[58] Field of Search ..... 335/21-24, 335/35, 167-175, 185-190

[56] References Cited

U.S. PATENT DOCUMENTS

| | | | |
|---|---|---|---|
| 4,713,638 | 12/1987 | Grunert et al. | 335/172 |
| 4,782,583 | 11/1988 | Castonguay et al. . | |
| 4,945,443 | 7/1990 | DeBiasi et al. . | |
| 4,983,939 | 1/1991 | Shea et al. | 335/172 |
| 5,027,092 | 6/1991 | Castonguay et al. | 335/21 |

*Primary Examiner*—Harold Broome
*Assistant Examiner*—Lincoln Donovan
*Attorney, Agent, or Firm*—Richard A. Menelly; Fred Jacob

[57] ABSTRACT

An operating mechanism assembly used within molded case circuit breakers employing electronic trip units interconnects the operating mechanism with the circuit breaker movable contact arms by means of a slotted-cam arrangement. The slotted-cam optimizes the manual closing of the movable contact arms by controllably over-centering the circuit breaker operating mechanism springs.

7 Claims, 2 Drawing Sheets

MOLDED CASE CIRCUIT BREAKER OPERATING MECHANISM ASSEMBLY

BACKGROUND OF THE INVENTION

The incorporation of an electronic trip circuit within the covers of molded case circuit breakers has resulted in a compact arrangement of the internal circuit breaker operating components. The positioning of the trip unit printed wire board within the circuit breaker cover next to the circuit breaker operating handle requires that the operating mechanism open and close the circuit breaker contacts with a minimum stroke of the externally accessible circuit breaker operating handle. U.S. Pat. No. 4,945,443 describes one such circuit breaker having an electronic trip unit within the circuit breaker. The electrical parameters are visually accessed by means of a keypad and display arranged on the exterior surface of the circuit breaker cover.

A compact circuit breaker operating mechanism is described within U.S. Pat. No. 4,782,583 entitled "Method of Assembling a Molded Case Circuit Breaker Crossbar", which operating mechanism interconnects between the externally accessible circuit breaker operating handle and the movable contact arm by means of an operating cam assembly.

U.S. patent application Ser. No. 330,521 filed Mar. 30, 1989 entitled "Molded Case Circuit Breaker Movable Contact Arm Arrangement" describes a molded case circuit breaker using an electronic trip unit to articulate the circuit breaker operating mechanism to separate the circuit breaker contacts upon the occurrence of an overcurrent condition of predetermined magnitude and duration. The current limiting feature of the circuit breaker whereby the fixed and movable contacts in one phase become electrodynamically separated before the operating mechanism responds to separate the fixed and movable contacts within the remaining phases, requires the use of contact springs to hold the fixed and movable contacts against electrodynamic forces induced by momentary current surges. The movable contact arm is reverse-biased to a closed position by means of a pair of powerful contact springs which hold the movable contact attached to the end of the movable contact arm tightly against the fixed contact assembled on the bottom of the circuit breaker case. When the circuit breaker operating handle manually drives the movable contact arm and the attached movable contact from the open position distal the fixed contact, to the closed position against the fixed contact, the reverse bias of the spring force against the movable contact arm must first be overcome in order for the operating mechanism springs to over-center and drive the movable contact arm to its open and closed positions. The powerful contact springs necessitate the corresponding use of a pair of even more powerful operating mechanism springs to overcome the contact spring reverse bias during the manual opening and closing operation and to provide an over-center "OFF" position.

One purpose of the invention accordingly is to provide means for overcoming the reverse bias of the circuit breaker contact springs during the manual contact closing operation without requiring operating mechanism springs of increased strength.

SUMMARY OF THE INVENTION

A circuit breaker operating assembly for opening and closing the circuit breaker contacts both manually and automatically interconnects with the circuit breaker movable contact arms by a slotted cam arrangement. The geometry of the cam slot increasingly torques the movable contact arm both during manual contact closing and manual contact opening of the circuit breaker contacts.

DESCRIPTION OF THE PREFERRED EMBODIMENT

Figure 1:
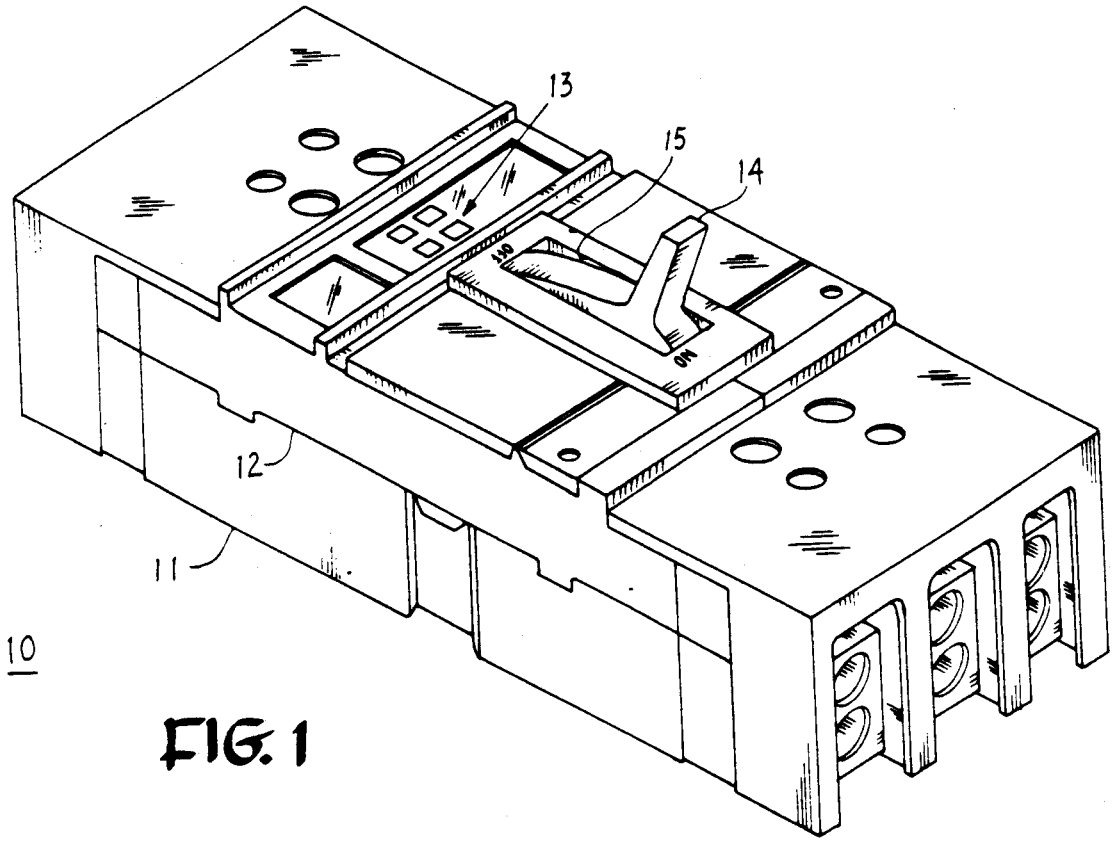
FIG. 1 is a top perspective view of a molded case circuit breaker employing an electronic trip unit contained within the circuit breaker cover.

A molded case circuit breaker 10 is shown in FIG. 1 and consists of a molded case 11 to which a molded plastic cover 12 is fixedly attached. An electronic trip unit such as described in aforementioned U.S. Pat. No. 4,945,443 is arranged within the circuit breaker cover and visual access to the electrical parameters is obtained by means of the keypad and visual display 13. Manual intervention for turning the circuit breaker contacts between their open and closed conditions is provided by means of an operating handle 14 that extends through an elongated slot 15 formed in the circuit breaker cover.

Figure 2:
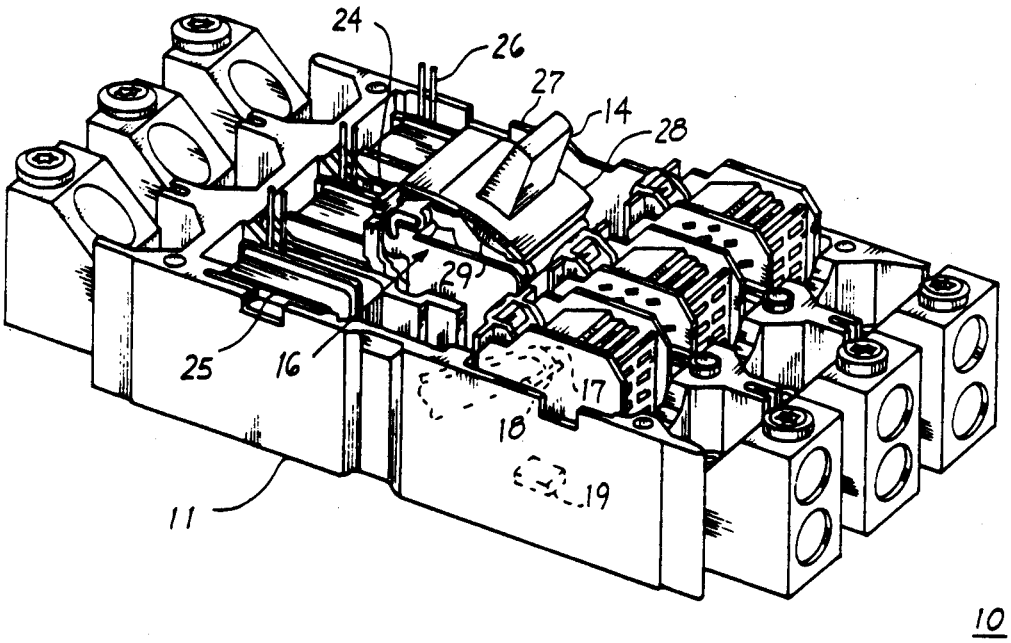
FIG. 2 is a top perspective view of the circuit breaker of FIG. 1 with the cover removed to depict the circuit breaker operating mechanism assembly.
Figure 3:
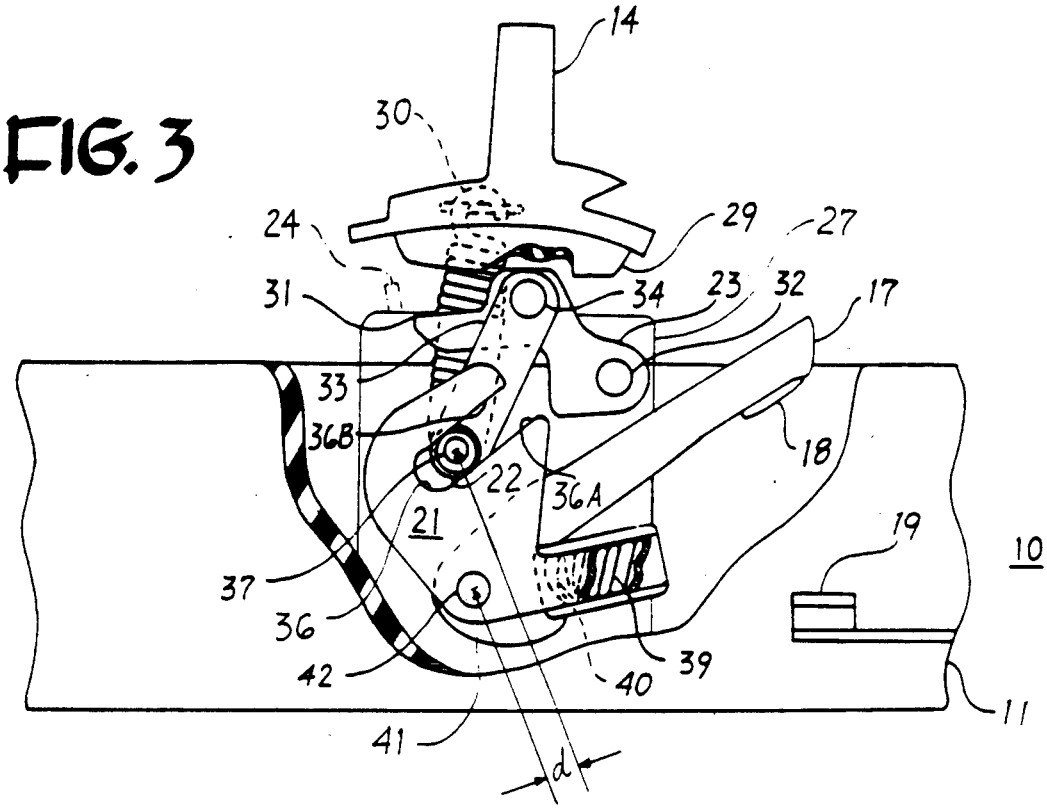
FIG. 3 is an enlarged side view of the circuit breaker case of FIG. 2 with the part of the circuit breaker case removed to depict the circuit breaker operating mechanism assembly with the circuit breaker contacts in the open condition.

The circuit breaker components within the circuit breaker case 11 are best seen by referring now to the circuit breaker 10 depicted in FIG. 2 with the cover removed to show the operating mechanism generally indicated at 16. Six movable contact arms 17, two for each phase of an associated protective circuit, are arranged such that the movable contacts 18 at one end of the movable contact arms 17 are moved in and out of abutment with associated fixed contacts 19 that are arranged within the circuit breaker case. As described within aforementioned U.S. Pat. No. 4,782,583, the movable contact arms 17 are driven between their open and closed positions by articulation of the operating mechanism 16 upon release of the operating cradle 23 as shown in FIG. 3. The operating mechanism connects with the movable contact arms by means of a slotted cam 21 and a pair of rollers 22 that are pivotally connected with the operating cradle 23. As described within the aforementioned U.S. patent application Ser. No. 330,521 the operating cradle is retained by means of a latch 24 until released by operation of the electronic trip unit upon the occurrence of an overcurrent condition within the associated protective circuit as seen by referring back to FIG. 2. The circuit current is sensed by means of current transformers 25 and is transmitted to the electronic trip unit by means of the upstanding pin connectors 26. The handle yoke 29 arranged interior to the operating mechanism side frames 27 pivotally connects with the operating mechanism side frames at the bottom end and with the operating handle 14 at the top end by means of the handle skirt 28.

The cooperation between the operating cradle 23, slotted cam 21 and movable contact arm 17 is best seen by referring again to the circuit breaker 10 in FIG. 3 wherein the movable contact arm 17 is depicted in its open position with the movable contact 18 separated from the fixed contact 19 within the circuit breaker case 11 and with the hook 31, operating cradle 23 retained under the latch 24. The movable contact arm is held in its open position by means of the operating springs 30 which hold the rollers 22 against the cam surfaces 36A, 36B of the slotted cam 21. The contact springs 39 which operate to hold the contacts in the closed position are in the form of compression springs which force a button-shaped cam 40 at the top of the compression springs against the knee 41 formed next to the movable contact arm pivot 42 to provide contact pressure. The rollers 22 at the ends of the axle pin 37 slidingly engage the elongated cam slot 36 and move reciprocally within the slot as the operating handle 14 and attached handle yoke 29 drive the cam 21 which in turn drives the compression springs 39 and shaped cam 40 to supply the required contact pressure in its closed position. As described within the aforementioned U.S. patent application Ser. No. 330,521 the operating cradle 23 pivots at one end by means of the pivot pin 32 extending between the operating mechanism side frames 27, one of which is removed for purposes of clarity, and has the shaped cradle hook 31 at the opposite end for engaging with the latch 24 as depicted in phantom. With the operating cradle thus engaged with the latch, the rollers 22 carried by the cradle link 33 which is pivotally attached to the operating cradle 23 by means of the link pivot 34 now allows the operating handle 14 and handle yoke 29 to drive the operating mechanism springs 30 to their over-center position and thereby rapidly drive the movable contact arm to its closed position. To facilitate the over-centering of the mechanism operating springs, the sides 36A, 36B of the cam slot 36 are parallel to each other such that the distance d measured between the movable contact arm pivot 42 and the axle pin 37 increases as the operating handle 14 is moved from the open position depicted in FIG. 3 to the closed position depicted in FIG. 4 to which reference is now made.

Figure 4:
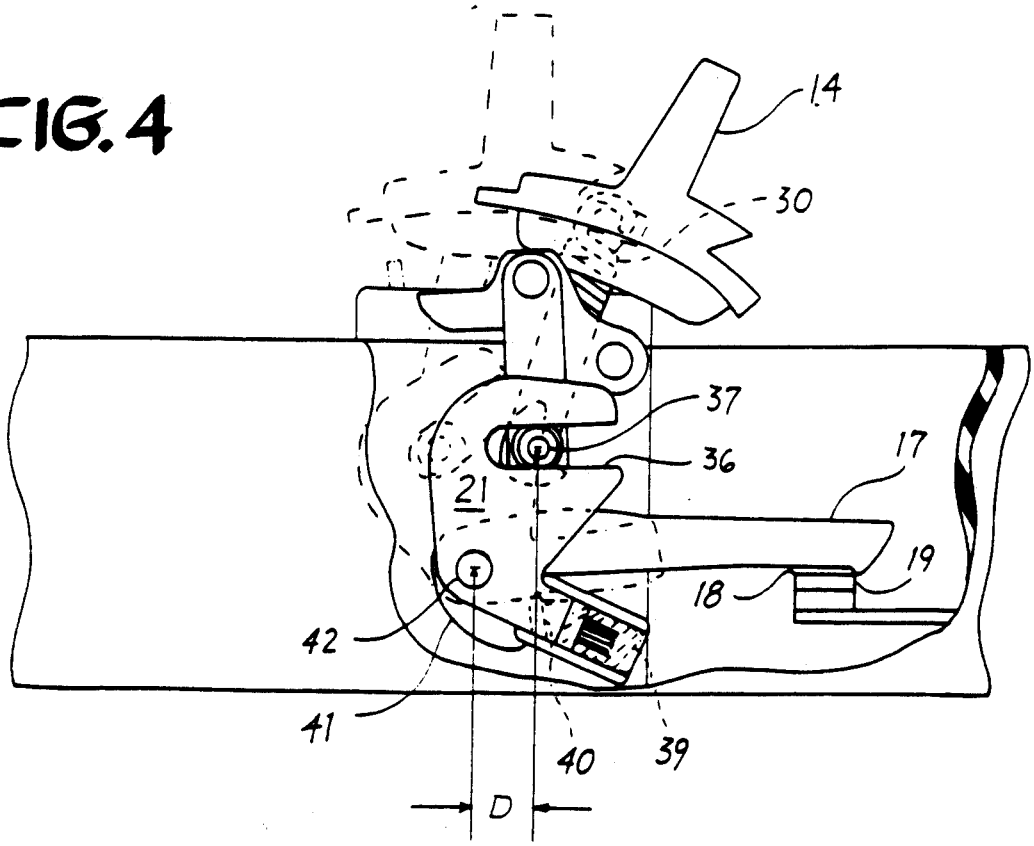
FIG. 4 is an enlarged side view of the circuit breaker case of FIG. 3 with the circuit breaker contacts in the closed condition.

Moving the operating handle 14 from the open position indicated in phantom to the closed position indicated in solid lines, rotates the slotted cam 21 and cam slot 36 clockwise, as viewed in FIGS. 3 and 4, about the movable contact arm pivot 42 from the position indicated at d in FIG. 3 to that indicated at D in FIG. 4. As described earlier, the distance measured between the movable contact pivot 42 and the axle pin 37 increases as the slotted cam rotates, in the clockwise direction which effectively reflects an increase in the torque acting on the movable contact arm 17 as defined by the product of the force exerted by the operating springs 30 times the distance measured between the movable contact arm pivot 42 and the axle pin 37. The increasing torque on the slotted cam 21 is greater than and overcomes the reverse bias acting on the slotted cam in the counterclockwise direction by virtue of the contact springs 39 and shaped cam 40 against the knee 41 of the movable contact arm 17. The torque operating on the slotted cam 21 in the clockwise direction accordingly exceeds the reverse bias provided by the contact springs such that the operating mechanism springs 30 rapidly over-center to drive the movable contact arm 17 and the attached movable contact 18 into abutment with the fixed contact 19 as shown in FIG. 4.

Having thus described our invention, what we claim as new and desire to secure by Letters Patent is:

1. A molded case electric circuit breaker comprising:

a plastic cover and case;

a fixed and a movable contact arranged for connection with an external electric circuit, said movable contact being attached to one end of a movable contact arm;

an operating mechanism within said case arranged for moving said movable contact arm and said attached movable contact to automatically interrupt current through said external circuit upon occurrence of an overcurrent condition;

an operating handle externally-accessible through said cover and operably connected with said operating mechanism for manually moving said movable contact arm and said attached movable contact between open and closed positions;

a pair of operating springs within said operating mechanism moving to an over-center position and providing an opening force and a closing force on said movable contact arm when said operating handle moves said movable contact arm and said attached movable contact between said open and closed positions;

a pair of contact springs abutting an opposite end of said movable contact arm, said contact springs providing a reverse bias force to said movable contact arm to hold said attached movable contact against said fixed contact;

an operating cradle pivotally-attached within said operating mechanism retaining said movable contact arm against a tripping force provided by said operating springs;

a cradle link pivotally-attached to said operating cradle at one end and carrying roller means at an opposite end; and a slotted cam connected with said movable contact arm and moving said movable contact arm in unison with said operating handle, said slotted cam including a pair of linear slots each of said slots being defined by a pair of parallel opposing sides, whereby said roller means positioned within said slots provide an opening and closing torque on said movable contact arm in excess of said reverse bias force.

2. The circuit breaker of claim 1 including an enclosure attached to said slotted cam, said contact springs being retained within said enclosure.

3. The circuit breaker of claim 1 wherein said springs comprise compression springs.

4. The circuit breaker of claim 1 wherein said contact springs contact said movable contact arm through a shaped cam.

5. The circuit breaker of claim 1 wherein said cradle link comprises a pair of parallel links joined by an axle pin.

6. The circuit breaker of claim 5 wherein said roller means comprise a pair of rollers, one on each end of said axle pin.

7. The circuit breaker of claim 6 wherein said slotted cam comprises a pair of parallel side arms, each side arm including a corresponding one of said slots.

* * * * *